US010836527B2

(12) United States Patent
Apparuti et al.

(10) Patent No.: US 10,836,527 B2
(45) Date of Patent: Nov. 17, 2020

(54) DEVICE AND A METHOD FOR MAINTAINING A GAS FLOW BARRIER BETWEEN TWO INTERCONNECTED VOLUMES

(75) Inventors: Daniele Apparuti, Montale Rangone (IT); Ulf Lindblad, Lund (SE); Jenny Olsson, Bjärred (SE); Michael Kok Olsson, Malmö (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 1511 days.

(21) Appl. No.: 13/378,008

(22) PCT Filed: Jun. 24, 2010

(86) PCT No.: PCT/SE2010/000175
§ 371 (c)(1),
(2), (4) Date: Dec. 13, 2011

(87) PCT Pub. No.: WO2011/002378
PCT Pub. Date: Jan. 6, 2011

(65) Prior Publication Data

US 2012/0085418 A1 Apr. 12, 2012

(30) Foreign Application Priority Data

Jul. 3, 2009 (SE) ..... 0900911

(51) Int. Cl.
*F17D 3/00* (2006.01)
*B65B 55/10* (2006.01)
(Continued)

(52) U.S. Cl.
CPC ..... *B65B 55/10* (2013.01); *B65B 43/52* (2013.01); *B65B 3/027* (2013.01); *Y10T 137/0318* (2015.04); *Y10T 137/8593* (2015.04)

(58) Field of Classification Search
CPC ..... B65B 55/10; B65B 43/52
(Continued)

(56) References Cited

U.S. PATENT DOCUMENTS 5,464,595 A * 11/1995 Finnah ..... 422/297
5,934,992 A * 8/1999 Sohier ..... F24F 3/1607 454/190
(Continued)

FOREIGN PATENT DOCUMENTS

DE 10 2007 015 754 B3 5/2008
EP 0 903 294 A1 3/1999
(Continued)

OTHER PUBLICATIONS

Translation of JP 11-178515 Jul. 1999.*
(Continued)

*Primary Examiner* — Regina M Yoo
(74) *Attorney, Agent, or Firm* — Buchanan Ingersoll & Rooney PC

(57) ABSTRACT

A method and a device for maintaining, in a filling machine, a gas flow barrier between two volumes of a channel, wherein the channel is used for transportation of packages in a length direction thereof, and the volumes comprise a first volume having a first degree of sterilization and a second volume having a second degree of sterilization, and wherein the first volume comprises a gas injection mechanism, the second volume comprises a gas evacuation mechanism, and the first and the second volume meet in an interface area extending in a length direction of the channel. The method comprises arranging, divergent jets flowing from the gas injection mechanism such that the divergent jets of gas cooperate in the interface region for the generation of a
(Continued)

unidirectional flow in the direction from the first volume towards the second volume in the interface area, and thus forming a gas flow barrier.

12 Claims, 2 Drawing Sheets

(51) Int. Cl.
*B65B 43/52* (2006.01)
*B65B 3/02* (2006.01)

(58) Field of Classification Search
USPC ..... 422/292, 300, 302
See application file for complete search history.

(56) References Cited

U.S. PATENT DOCUMENTS

| | | | | |
|---|---|---|---|---|
| 6,041,834 | A | 3/2000 | Fujikawa et al. | |
| 6,544,473 | B1 * | 4/2003 | Shintaku | B65B 55/10 422/1 |
| 6,702,985 | B1 * | 3/2004 | Taggart et al. | 422/28 |
| 6,916,445 | B2 * | 7/2005 | Centanni et al. | 422/22 |
| 7,186,374 | B2 * | 3/2007 | Zelina et al. | 422/28 |
| 7,849,788 | B2 * | 12/2010 | Macaluso | 99/536 |
| 2005/0118057 | A1 * | 6/2005 | Quetel et al. | 422/24 |
| 2006/0067856 | A1 | 3/2006 | Martensson et al. | |
| 2006/0231519 | A1 * | 10/2006 | Py | B65D 51/002 215/342 |
| 2007/0253863 | A1 * | 11/2007 | Iwashita et al. | 422/28 |
| 2009/0232697 | A1 | 9/2009 | Martensson et al. | |
| 2010/0021359 | A1 * | 1/2010 | Auer | B65B 55/10 422/291 |
| 2010/0077701 | A1 | 4/2010 | Ehmer | |
| 2010/0252142 | A1 | 10/2010 | Adriansens | |

FOREIGN PATENT DOCUMENTS

| | | | | |
|---|---|---|---|---|
| EP | 0 903 297 | A1 | 3/1999 | |
| JP | 63-178926 | A | 7/1988 | |
| JP | 11-091701 | A | 4/1999 | |
| JP | 11-178515 | * | 7/1999 | A23L 1/015 |
| JP | 2006-508873 | A | 3/2006 | |
| JP | 2008-143558 | A | 6/2008 | |
| WO | WO 2004/054883 | A1 | 7/2004 | |
| WO | WO 2009011541 | A1 * | 1/2009 | A61L 2/22 |
| WO | 2009/062863 | A2 | 5/2009 | |

OTHER PUBLICATIONS

Office Action dated Apr. 8, 2014, by the Japan Patent Office in corresponding Japanese Patent Application No. 2012-517444, and an English Translation of the Office Action. (6 pages).
International Search Report (PCT/ISA/210) dated Oct. 7, 2010, by Swedish Patent Office as the International Searching Authority for International Application No. PCT/SE2010/000175.

* cited by examiner

DEVICE AND A METHOD FOR MAINTAINING A GAS FLOW BARRIER BETWEEN TWO INTERCONNECTED VOLUMES

TECHNICAL FIELD

The present invention relates to a method and a device for maintaining a gas flow barrier between two interconnected volumes. The present invention is particularly useful for maintenance of separation between two volumes having different atmospheres in regard of degree of sterilization, and is applicable in the context of filling machines for filling preformed packaging containers with a food product.

TECHNICAL BACKGROUND

In the context mentioned above the preformed packaging containers are processed in a filling machine. The preformed packaging containers may be of the type commonly referred to as ready-to-fill packaging containers, having a tubular body provided with shoulders and an opening device in the one end, and being open in the opposing end. In a filling machine such packaging containers are heated, subjected to sterilization, vented for removal of residual sterilization agent, and subsequently filled and sealed. These processing steps are exerted on the packages as they are transported in a machine direction through a channel. The term sterilization is taken to signify in the following disclosure that the package, after sterilization, attains a level of sterilization which is designated commercially sterile. It is apparent that the level of sterilization is determined by the properties during sterilization and by the properties of the atmosphere to which the interior of the package is subjected prior to being sealed. The adequate sterile conditions thus need to be maintained throughout the processing steps following the sterilization.

The packages are transported through the process on a transport arrangement having carrier means for carrying the packages by their closed end, and starting with the sterilization step the interior of the package needs to be kept under aseptic conditions until the package has been sealed. The filling machine may generally be an intermittent machine in which packages are transported forward from one station to the next, however, the invention, as it will be presented in the following, may also be used in a machine having a continuous flow of packages.

An apparatus of the above kind, and a corresponding method for producing and sterilizing and filling package which is referable to this context, is disclosed in published international Application WO2004/054883. In that particular application two commonly used approaches for maintaining sterile conditions are disclosed;

1) maintenance of a higher pressure in a sterilization zone than in surrounding zones, so as to avoid introduction of contaminated air into the sterilization zone;

2) arrangement of a unidirectional flow of sterilization agent in the direction from the open end of the packaging container towards the closed end of the same, so as to avoid recontamination of the interior of the packaging container. For this purpose the sterilization zone of this prior art device comprises means for controlling the flow of gaseous sterilization agent in a top portion of the sterilization zone, and means to evacuate the sterilization agent in a lower portion of the sterilization zone.

In zones subsequent the sterilization zone (downstream in the machine direction) the maintenance of aseptic conditions may be achieved with analogous techniques, though involving sterile air instead of sterilization agent.

Though being functional, the creation of a unidirectional flow requires large mass flows of air, which necessitates a corresponding high capacity of auxiliary equipment, such as fans and filters etc. The low-velocity flow is in practice effected by ejecting the air through large perforated plates, which have to be cleaned externally and manually when the machine is cleaned. This is obviously labor intensive. Also, the low-velocity flow may be sensitive to flow disturbances, which implies that the flow pattern in neighboring zones needs to be controlled.

Thus, it is apparent that there is room for an alternative and in some aspects improved device and method for maintenance of aseptic conditions, which is what is provided by the present invention.

SUMMARY

The present invention addresses the above problems by means of a new method, having obvious advantages in relation to prior-art, as well as by means of a new filling machine designed to perform the method. The method is defined in claim 1 and the device is defined in claim 7. Specific embodiments are defined in the corresponding dependent claims.

In a machine of the above kind it may be considered to be overly complicated and laborious to keep larger portions of the machine sterile at all times, in particular the transport arrangement with its carrier means, since these will pass through aseptic as well as non-aseptic zones on its way. Therefore the channel through which the packages are transported may be operationally divided into two sub volumes; an aseptic volume comprising the open end of the packaging container and a portion of the body extending from said open end; and a non-aseptic volume comprising the carrier means the opposing end of the packaging container, basically for achieving the effects mentioned in relation to alternative 2) above. By maintaining a continuous interface area between these two sub volumes the aseptic conditions inside of the packaging container may be maintained following the sterilization. The present invention solves this issue by providing a method for maintaining, in a filling machine, a gas flow barrier between two volumes of a channel, said channel being used for transportation of packages in a length direction thereof, and said volumes comprising a first volume having a first degree of sterilization, and a second volume having a second degree of sterilization, wherein the first volume comprises gas injection means, the second volume comprises gas evacuation means, the first and the second volume meet in an interface area extending in a length direction of the channel, comprising the step of arranging turbulent, divergent jets flowing from the gas injection means such that the divergent jets of gas cooperate in the interface region for the generation of a unidirectional flow in the direction from the first volume towards the second volume in the interface region, and thus forming a gas flow barrier.

The present invention makes use of the fact that the flow inside the first volume may be directed in any preferred direction, as long as the direction of the flow in the interface area is appropriate. The high-velocity flow from the gas injection means will have a considerable momentum, and will not be as sensitive as a unidirectional flow generated by a perforated plate solution, in respect of flow disturbances caused by other mechanism in the same zone or in neighboring zones. Such mechanisms may be the injection of sterilization gas into the package in the sterilization zone, or injection of ventilation gas in the venting zone, etc. The present invention facilitates the provision of a gas barrier without the provision of a unidirectional flow in the entire volume or an overpressure in the entire volume. The inventive method also limits the number of gas injection means needed. While the prior art use of a perforated plate required a vast number of holes for gas injection, in order for the flow to be laminar and homogenous, the inventive method permits the use of just a few gas injection means per package in the zone.

In one or more embodiments the open end of the package may occupy the first volume and the opposite end is carried by carrier means arranged in the second volume. In order to ensure aseptic or sterile conditions, inside the package it is not necessary for the entire outer surface of the package to be kept sterile. It suffices that the inside of the package and an area adjacent to the boundary between the inside and the outside is kept aseptic or sterile. This area, on the other hands, has to be well defined and large enough to ensure proper sterilization and prevent reinfection. Having the carrier means arranged in the second volume eliminates the need of sterilizing them, which facilitates the maintenance of sterile conditions.

According to one or more embodiments a flow restrictor defining and decreasing the interface area is arranged between the first volume and the second volume. The flow restrictor will facilitate the arrangement of a gas flow barrier, by stabilizing the turbulent flow at a well-defined position. The flow restrictor may be provided in the form of indentations in each opposing channel wall, giving the channel an hourglass-shaped cross section orthogonal to the machine direction. The waist of the hourglass shape is dimensioned to minimize the interface area between the first and the second volume while allowing packages to pass, and is designed to stabilize the turbulent flow. It should be emphasized that since packages may be discarded on their way to the filling machine, some package carriers may be empty, and the gas flow barrier must be maintained with or without a package present in the interface area, and the flow restrictor will assist in this.

In one or more embodiments the gas injection means comprise circular openings in the uppermost portion of the channel. The use of circular openings is beneficial from a processing standpoint, when the machine performing the method is manufactured. The location and construction of the gas injection means also results in particular advantages. The gas injection means form a structural component of the actual channel, rather than being formed of an assembly of separate components. This may be compared to a prior art solution using perforated plates, in which case a complex and bulky air feeding system needs to be arranged upstream the perforated plates, and when cleaned the perforated plates often have to be removed and be cleaned manually. In an inventive solution the gas injection means are simply fed with sterile air via conduits. Also, by using a simple switch valve cleaning may be facilitated, such that when performing automated cleaning of the machine, a valve is simply activated to permit cleaning fluid to enter the conduit leading to the gas injection means and the entire gas injection mechanism is cleaned.

In one or more embodiments the gas injection means may be arranged at a fixed relationship along two lines extending symmetrically along a central axis of the length direction of the channel and in other embodiments the gas injection means may have the form of longitudinal slits in the transportation direction, such that a two slits may be used for the maintenance of the gas flow barrier in an entire zone.

The invention also relates to a device designed to perform the inventive method, giving the same advantages as disclosed above. A device for maintenance of a gas flow barrier between two volumes of a channel in a filling machine, said channel being adapted for transportation of packages in a length direction thereof, and said volumes comprising a first volume with a first degree of sterilization, and a second volume with a second, lower, degree of sterilization, wherein the first volume comprises gas injection means, the second volume comprises gas evacuation means, the first and the second volume meet in an interface area extending in a length direction of the channel, characterized in that the gas injection means injects turbulent, divergent, jets of gas such that the divergent jets of gas meet in the interface region for the generation of a unidirectional flow in the direction from the first volume towards the second volume in the interface region, and thus a gas flow barrier.

In one or more embodiments the two volumes may meet in a portion of the channel having a reduced cross section in a direction perpendicular to the length direction of the channel, such as to improve the flow pattern in the interface region between the volumes.

The second volume may comprise, or house, carriers for conveying packages by their closed end, and the gas injection means comprises nozzles in the uppermost portion of the first volume, remote to the interface region.

As discussed in relation to the method the nozzles may comprise circular openings in the uppermost portion of the channel, and the nozzles may be arranged at a fixed relationship along two lines extending symmetrically along a central axis of the length direction of the channel.

The above features may be used in combination or separately.

DETAILED DESCRIPTION

Figure 1:
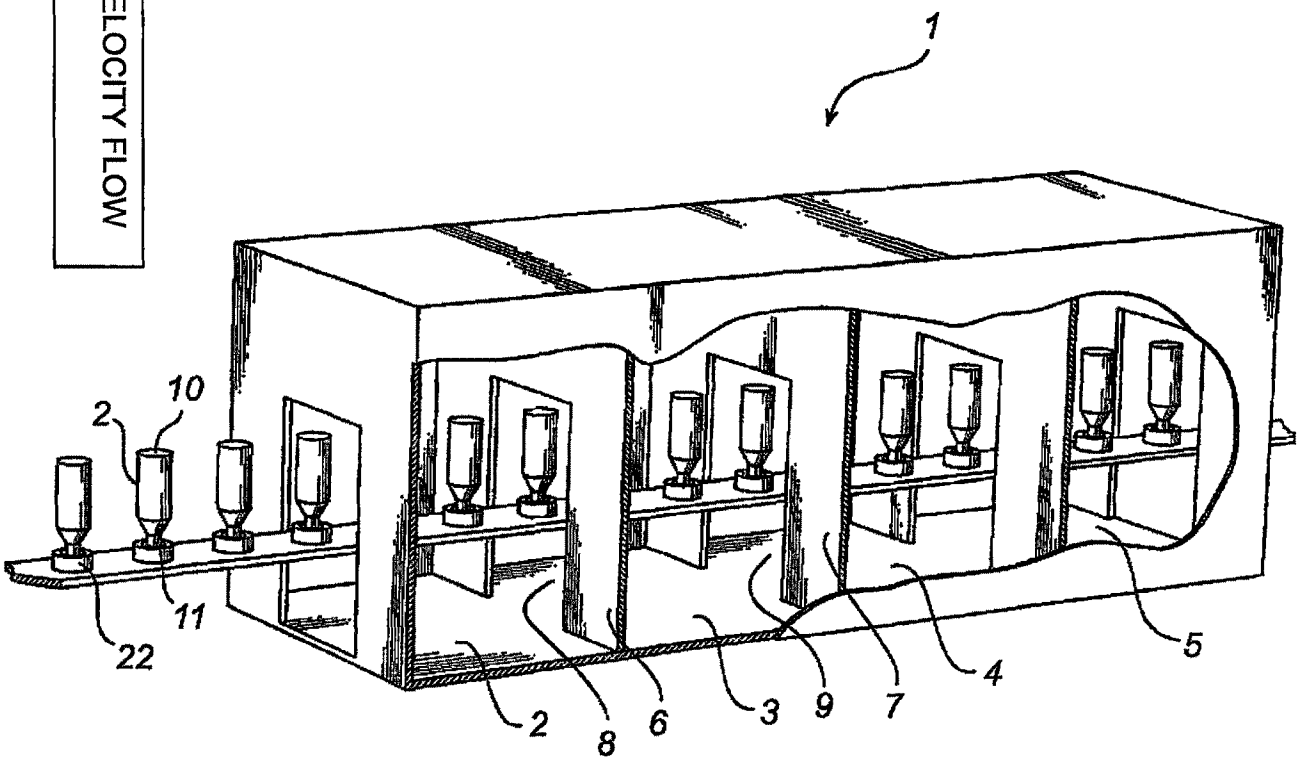
FIG. 1 is a schematic perspective view, partly in cross section, of a prior art filling machine used for filling of Ready-to-Fill-packages.
Figure 5:
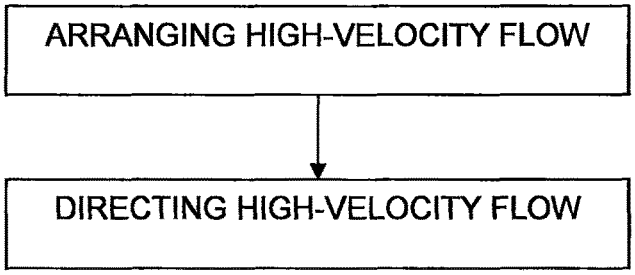
FIG. 5 is a flowchart showing the inventive method.

FIG. 1 illustrates a prior art filling machine, as disclosed in the previously mentioned application WO2004/054883. The device 1 has a heating zone 2, a sterilization zone 3, and a venting zone 4 and connected thereto a filling zone 5. As may be seen in FIG. 1, the zones 2-5 are separated from each other by partitionings 6, 7 arranged between the zones. In each partitioning 6, 7 there is an opening 6*a*, 7*a*. Packages 8 are arranged in holders 9 on a conveyor belt 10 which passes through the zones 2-5. The packages 8 stand on their closed top end 11 with their open bottom end 12 directed upwards.

In the heating zone 2 there is a nozzle arrangement (not shown) in a top portion thereof for introduction of hot, filtered air. In a bottom portion of the heating zone 2 there are outlets (not shown) for withdrawing the hot air.

Similarly, there are nozzles (not shown) for introduction of gaseous hydrogen peroxide in a top portion of the sterilization zone 3. In a bottom portion of the sterilization zone there are outlets (not shown) for withdrawing hydrogen peroxide.

The venting zone 4 also has nozzles (not shown) for introducing hot sterile air in a top portion. In a bottom portion of the venting zone 4 there are outlets (not shown) for withdrawing hot air.

In a manner similar to the heating, sterilization and venting zones 2-4, the filling zone 5 has nozzles 26 for introducing sterile air in a top portion 27 of the filling zone.

The filling machine also has a gas production unit for producing the gaseous hydrogen peroxide used for sterilization, as well as a catalyst unit for degrading hydrogen peroxide gas withdrawn from the sterilization zone.

Figure 2:
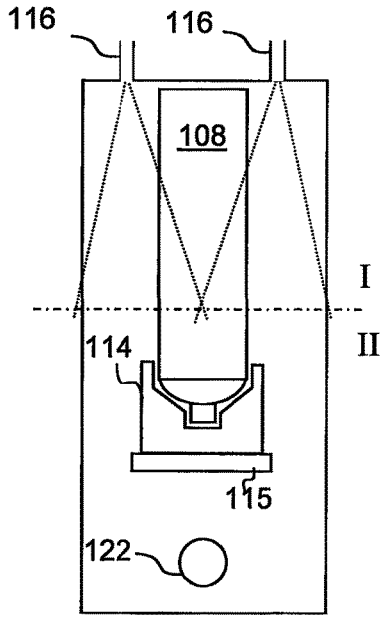
FIG. 2 is a schematic sectional view, orthogonal to a transportation direction, of a filling machine according to a first embodiment.

FIG. 2 illustrates a first embodiment of the invention, and represents a schematic cross section, orthogonal to the transportation direction of the packages, in the filling zone of the filling machine. The package 108 is carried by a carrier 114 attached to a transportation line 115. Two rows of gas injection means in the form of circular nozzles 116 are arranged in the top of the zone, and these inject sterile air downwards. The injected air from each nozzle 116 forms a diverging flow, as indicated by the dotted lines extending from the nozzle opening, on its way downwards. From a fluid mechanics standpoint the flow is turbulent, yet not highly turbulent, and it will not be described in detail here. In one practical example an exit velocity may be in the region of 10-20 m/s, e.g. 13 m/s, and the nozzle-hole diameter 4 mm, i.e. in the turbulent region or transitional region. The dash-dotted line indicates the approximate position of an interface area between the first volume, above the line, and the second volume, below the line. In the same examples the nozzles 116 are arranged in two rows, with about 20 mm center-to-center distance of adjacent nozzles 116. In the interface area, there will always be a unidirectional flow, efficiently forming a gas flow barrier preventing mass transport from the second volume (II) to the first (I). The aseptic or sterile first volume may thus remain aseptic or sterile, independently of the atmosphere in the second volume. The level of the interface area (in the up-down direction in FIG. 2) may vary depending on if a package 108 is present or not, as well as during transportation of the package 108, but it must be stressed that the flow in the interface area will remain continuous at all times, which results in that a fixed and reliable level may be established above which the sterile or aseptic conditions are maintained, in the atmosphere as well as on surfaces of the machine and the package. The nozzles 116 may be arranged in rows, generally in pairs of nozzles 116 so as to define a symmetric setup. In the drawings there is one set of nozzles for each package indexing position, yet in the present working apparatus the nozzles 116 are arranged with a smaller distance in between, such that more than one pair of nozzles 116, on an average, is arranged in each indexing position. Since the generated flow is of relatively high velocity it will not as easily affected by interfering flows as prior art techniques. E.g. when the inventive concept is used in the filling zone of a filling machine, the interfering flows generated by the flow of a product into the package 108 will not affect the continuity gas flow barrier in the interface region. Interfering flows from neighboring zones, such as from the venting zone, will not affect the maintenance of the gas flow barrier. Gas evacuation means 122 are arranged in the second volume for driven evacuation of the gas, and these may be used to balance the net flow in the filling machine.

Figure 3:
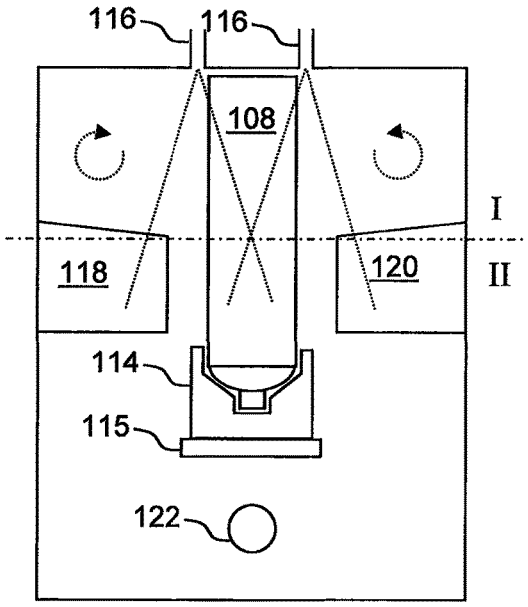
FIG. 3 is a cross section similar to FIG. 2, of a filling machine according to a second embodiment of the present invention.

FIG. 3 illustrates a second embodiment. In this embodiment flow restrictors 118, 120 have been arranged in the channel. In this way the void volume around a package 108 is reduced. This makes it possible to use less diverging injections of air through the nozzles 116, and easier to obtain a gas barrier, when a package 108 is present, when no package 116 is present, as well as during transportation of packages 108. The divergence of the nozzles 116 may be varied by varying their geometry, in a known manner. The flow restrictors will generate stabilized recirculation zones on the outside of the rows of nozzles 108 (in relation to an imaginary centerline between the nozzles), which is indicated by the curved, dotted arrows.

Figure 4:
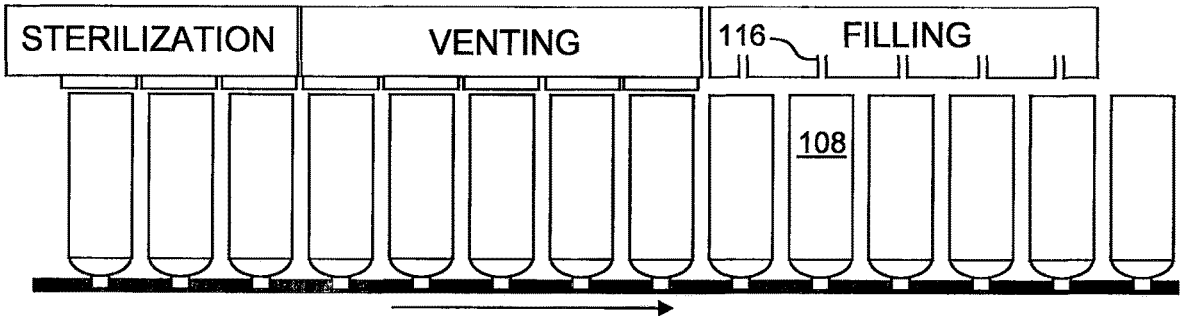
FIG. 4 is a cross sectional side view of a filling machine operating in accordance with the inventive method.

FIG. 4 is a schematic side view of a filling machine performing the inventive method. The arrow indicates the machine direction, in which the packages may be transported in an intermittent manner or in a continuous manner.

To summarize, some advantages of the present invention include that it may be optimized regarding the space it requires in the machine, and may have a much less space consuming design as compared to existing systems. This, e.g., facilitates the design of filling system and external cleaning, which has been described earlier in the application. With remained functionality it may be designed to require minimum cleaning effort. It has been described how prior art methods require manual cleaning of perforated plates. With the inventive technique cleaning of the nozzles 116 may be readily performed by injecting cleaning fluid instead of air through the injection system. The function of the present invention may also be maintained without the build-up of an overpressure, and it requires a comparatively small mass flow of air. Despite this, it may be used in environments where strong interfering flows are present. Some direct advantages of the less complex design are: simplified assembly during production, reduced downtime during service, etc.

In its most simplified design the nozzles 116 have a circular cross section, and are arranged as machined openings in the ceiling of the chamber. Openings with circular cross section are readily machined and they provide a symmetric flow pattern. The skilled person realizes, however, that the nozzles may have any suitable form without departing from the inventive concept as defined by the claims.

The present invention may be applied in a filling or packaging machine, further details of which are described in a number of copending Swedish patent applications, filed by the same applicant on the same day as the present application, which hereby are incorporated by reference. To this end further details of:

A nozzle that may be used when treating the interior of the packaging containers is disclosed in the application with the title "A device and a method for gaseous-treatment of packages" (SE-0900906-9).

A method for obtaining an optimized concentration of sterilization agent in a sterilization zone is disclosed in the application with the title "A device and a method for sterilizing packages" (SE-0900907-7).

A device and method for maintaining asepticity is also disclosed in "A device and a method for maintaining a gas flow barrier between two volumes of a channel" (SE-0900913-5).

A system for ensuring that entrainment air is present for the jet flows of the filling zone and venting zone is disclosed in the application with the title "A system for treating packaging containers" (SE-0900912-7).

A device for providing cleaned air, which may be used for the as a source of entrainment air to jets in the venting zone and filling zone and surplus air in the filling zone, is disclosed in the application with the title "A device for cleaned air provision" (SE-0900908-5).

Some various aspect of the filling or packaging machine are disclosed in the applications titled "Packaging machine and packaging method I" (SE-0900909-3) and "Packaging machine and packaging method II" (SE-0900910-1), respectively. A system for supplying entrainment air to jet air flows in the machine are disclosed in the application with the title "A system for treating packaging containers" (SE-0900912-7), relevant parts of which, as mentioned, are hereby incorporated by reference.

The invention claimed is:

1. A device for maintenance of a gas flow barrier between two volumes of a channel in a filling machine, the channel being configured for transportation of packages in a length direction of the channel, the device comprising:

a first volume with a first degree of sterilization;

a second volume with a second degree of sterilization that is lower than the first degree of sterilization;

nozzles in an upper portion of the first volume;

a gas evacuation opening in the second volume;

the first volume and the second volume meeting in an interface area extending in a length direction of the channel;

the channel including first and second side walls on opposite sides of the channel in a width direction of the channel, the width direction being orthogonal to the length direction of the channel;

the nozzles configured to inject turbulent, divergent, jets of gas directed toward the interface area, such that the divergent jets of gas meet in the interface area to generate a unidirectional flow in a first direction from the first volume toward the second volume in the interface area, the unidirectional flow forming the gas flow barrier preventing a flow in a second direction from the second volume toward the first volume; and the nozzles including first and second nozzles spaced apart from one another in the width direction of the channel, the first nozzle being closer to the first side wall than the second nozzle, and the second nozzle being closer to the second side wall than the first nozzle, the first and second nozzles being arranged and configured such that the divergent jet injected from the first nozzle intersects the first side wall, and the divergent jet injected from the second nozzle intersects the second side wall.

2. The device of claim 1, wherein the first and second volumes meet in a portion of the channel having a reduced cross section in a direction perpendicular to the length direction of the channel.

3. The device of claim 1, wherein the second volume comprises carriers for conveying the packages by their closed end.

4. The device of claim 1, wherein the nozzles are located in an uppermost portion of the first volume, spaced from the interface area.

5. The device of claim 4, wherein the nozzles comprise circular openings in the uppermost portion of the first volume.

6. The device of claim 4, wherein the nozzles are arranged at a fixed relationship along two lines extending symmetrically along a central axis of the length direction of the channel.

7. A device for maintenance of a gas flow barrier between two volumes of a channel in a filling machine, the channel being configured for transportation of packages in a length direction of the channel, the device comprising:

a first volume with a first degree of sterilization;

a second volume with a second degree of sterilization that is lower than the first degree of sterilization;

nozzles in an upper portion of the first volume;

a gas evacuation opening in the second volume;

the first volume and the second volume meeting in an interface area extending in a length direction of the channel;

the channel including first and second side walls on opposite sides of the channel in a width direction of the channel, the width direction being orthogonal to the length direction of the channel;

the nozzles being configured to inject turbulent, divergent, jets of gas directed toward the interface area, such that the divergent jets of gas meet in the interface area to generate a unidirectional flow in a first direction from the first volume toward the second volume in the interface area, the unidirectional flow forming the gas flow barrier preventing a flow in a second direction from the second volume toward the first volume;

a first flow restrictor positioned on the first side wall at the interface area;

a second flow restrictor positioned on the second side wall at the interface area; and the nozzles including first and second nozzles spaced apart from one another in the width direction of the channel, the first nozzle being closer to the first side wall than the second nozzle, and the second nozzle being closer to the second side wall than the first nozzle, the first and second nozzles being arranged and configured such that the divergent jet injected from the first nozzle intersects the first flow restrictor, and the divergent jet injected from the second nozzle intersects the second flow restrictor.

8. The device of claim 7, wherein the first and second volumes meet in a portion of the channel having a reduced cross section in a direction perpendicular to the package transportation direction.

9. The device of claim 7, wherein the second volume comprises carriers for conveying the packages by their closed end.

10. The device of claim 7, wherein the nozzles are located in an uppermost portion of the first volume, spaced from the interface area.

11. The device of claim 10, wherein the nozzles comprise circular openings in the uppermost portion of the first volume.

12. The device of claim 10, wherein the nozzles are arranged at a fixed relationship along two lines extending symmetrically along a central axis of the length direction of the channel.

* * * * *